US012760536B2

(12) United States Patent
Low

(10) Patent No.: US 12,760,536 B2
(45) Date of Patent: Oct. 13, 2026

(54) HANDHELD ROLLABLE TOOL FOR COVE BASE MOLDING INSTALLATION

(71) Applicant: David Low, Centralia, WA (US)

(72) Inventor: David Low, Centralia, WA (US)

( * ) Notice: Subject to any disclaimer, the term of this patent is extended or adjusted under 35 U.S.C. 154(b) by 291 days.

(21) Appl. No.: 18/587,737

(22) Filed: Feb. 26, 2024

(65) Prior Publication Data

US 2025/0270826 A1 Aug. 28, 2025

(51) Int. Cl.
*E04F 21/00* (2006.01)

(52) U.S. Cl.
CPC ..... *E04F 21/0069* (2013.01)

(58) Field of Classification Search
CPC ..... E04F 19/049; E04F 19/061; E04F 13/06; E04F 19/0481; E04F 19/04; E04F 19/0459; E04F 19/0477; E04F 19/06; E04F 21/185; E04F 21/1855; E04F 21/1844; E04F 21/24; B25B 31/00; B25B 9/00
USPC ..... 15/244.3, 98, 103.5; 401/195, 143; 33/526, 523, 405; 52/717.03, 288.1, 290
See application file for complete search history.

(56) References Cited

U.S. PATENT DOCUMENTS 3,617,082 A * 11/1971 Sparks ..... A47G 27/0487 294/8.6
4,949,604 A * 8/1990 Squires ..... A47G 27/0487 81/488
5,316,614 A * 5/1994 Phillips ..... B65H 35/0033 156/391
5,371,912 A * 12/1994 Hall ..... A47L 11/4069 15/98
5,971,453 A * 10/1999 Schlisner ..... E04F 21/0069 294/8.6
6,260,249 B1 * 7/2001 Collins ..... B05C 17/0227 29/235
6,554,902 B2 * 4/2003 Yan ..... B05B 17/00 15/210.1
10,806,320 B1 * 10/2020 Welbourne ..... A47L 11/38
2006/0182487 A1 * 8/2006 Sandoval ..... A47L 13/26 401/48
2012/0000160 A1 * 1/2012 Herbert ..... E04F 21/00 52/746.1
2019/0077623 A1 * 3/2019 Low ..... B65H 19/30
2021/0290028 A1 * 9/2021 Martinez ..... A47L 13/254

* cited by examiner

*Primary Examiner* — Peter J Macchiarolo
(74) *Attorney, Agent, or Firm* — Thomas E. Loop

(57) ABSTRACT

The invention is a handheld rollable tool for installing cove base molding at a juncture between a wall and a floor. It has a base with a grippable handle, rotatable wheels attached to the base within a recess, and an outwardly extending baseplate with a flat exterior surface. The outer face of the baseplate can be covered with a detachable felt or textile material to facilitate gliding of the tool over the cove base molding while simultaneously cleaning and/or buffing of the outer surface of the cove base molding during its installation. The handheld rollable tool is designed to nestle against the wall and floor at their juncture and, during use, roll back-and-forth with an applied pressure against the wall.

6 Claims, 4 Drawing Sheets

HANDHELD ROLLABLE TOOL FOR COVE BASE MOLDING INSTALLATION

TECHNICAL FIELD

The present invention relates generally to interior building construction and, more particularly, to tools for installing cove base molding along a wall at its base.

BACKGROUND OF THE INVENTION

Cove base molding is a type of trim that is used at the base of walls to add a finished look and to protect the wall from damage. Cove base molding is typically made of rubber or vinyl. It is installed at the base of a wall at the juncture between the wall and the floor.

The installation of cove base molding can be a labor-intensive process that requires precision and skill. Traditionally, the process involves applying an adhesive to the backside of the molding, positioning the molding at the desired location, and then applying pressure (via a roller or by hand) along the length of the molding and against the wall to ensure that the molding adheres properly to the wall. This process can be time-consuming and physically demanding, particularly in large spaces or in areas with complex wall configurations. Furthermore, the process can be messy, with the potential for adhesive to get onto the wall or floor, and/or onto the outside surface of the cove base molding itself. Thus, there is a need for a tool that can facilitate and streamline the process of installing cove base molding.

Accordingly, and although some progress has been made over the years with respect to tools and methods for installing cove base molding along a wall at its base within a building, there is still a need in the art for new tools and better ways to install cove base molding. The present invention fulfills these needs and provides for further related advantages.

SUMMARY OF THE INVENTION

In brief, the present invention is directed to a handheld rollable tool for installing cove base molding at a juncture between a wall (at its base) and a floor. The handheld rollable tool comprises: a base having a top section and a bottom section, wherein the top section is in the form of a grippable handle; rotatable wheels attached to the bottom section of the base within a recess; an outwardly extending baseplate having a substantially flat exterior face (that, when the handheld rollable tool is being used, is parallel to the wall and perpendicular to the floor). In some embodiments, the flat exterior face is optionally covered with a piece of detachable felt (or a felt-like material) and/or a textile material (which material(s) is soft, supple, and enables gliding of the tool along the cove base molding during its installation—while simultaneously cleaning and buffing the outside surface of the cove base molding). In practice, the handheld rollable tool (aka "the wall wiper") is configured to nestle up against the wall and the floor at their juncture and roll back-and-forth along the wall with an applied pressure (force) against the wall.

In other embodiments, the present invention is directed to, in combination, the handheld rollable tool and a scoring implement (for selectively scoring the cove base molding during its installation at corners) that is detachable connected to the top section of the base, as well as to methods for installing cove base molding along a bottom portion of a wall adjacent to a floor.

These and other aspects of the present invention will become more readily apparent to those of ordinary skill in the art when reference is made to the following detailed description in view of the accompanying drawings.

BRIEF DESCRIPTION OF THE SEVERAL VIEWS OF THE DRAWINGS

The accompanying drawings illustrate several embodiments and different aspects of the present invention and, together with the detailed description, serve to explain certain principles and operation of the invention. It will be appreciated by those skilled in the art that the particular embodiments illustrated in the drawings and described herein are exemplary, and as such they do not limit the scope of the invention as established by the appended claims.

In the drawings like reference numerals are used to designate like features throughout the several views of the drawings.

DETAILED DESCRIPTION OF THE INVENTION

Referring now to drawings, the present invention is directed to a handheld rollable tool 102 (aka "the wall wiper") designed for installing a selected cove base molding along a bottom portion of a wall adjacent to a floor. In an exemplary configuration, and as best shown in FIG. 1 through FIG. 4, the handheld rollable tool 102 of the present invention comprises a base 104 having a top section 106 and a bottom section 108 (that may, or may not, be integrally connected to each other). The base 104 is preferably made of a rigid material such as, for example, wood or a hard plastic. As shown, the top section 106 is semi-circular in shape and in the form of a handle configured to be gripped by a user's hand (shown in dashed-lines in FIG. 5). In other words, the top section 106 of the base 104 is grippable.

Figure 1:
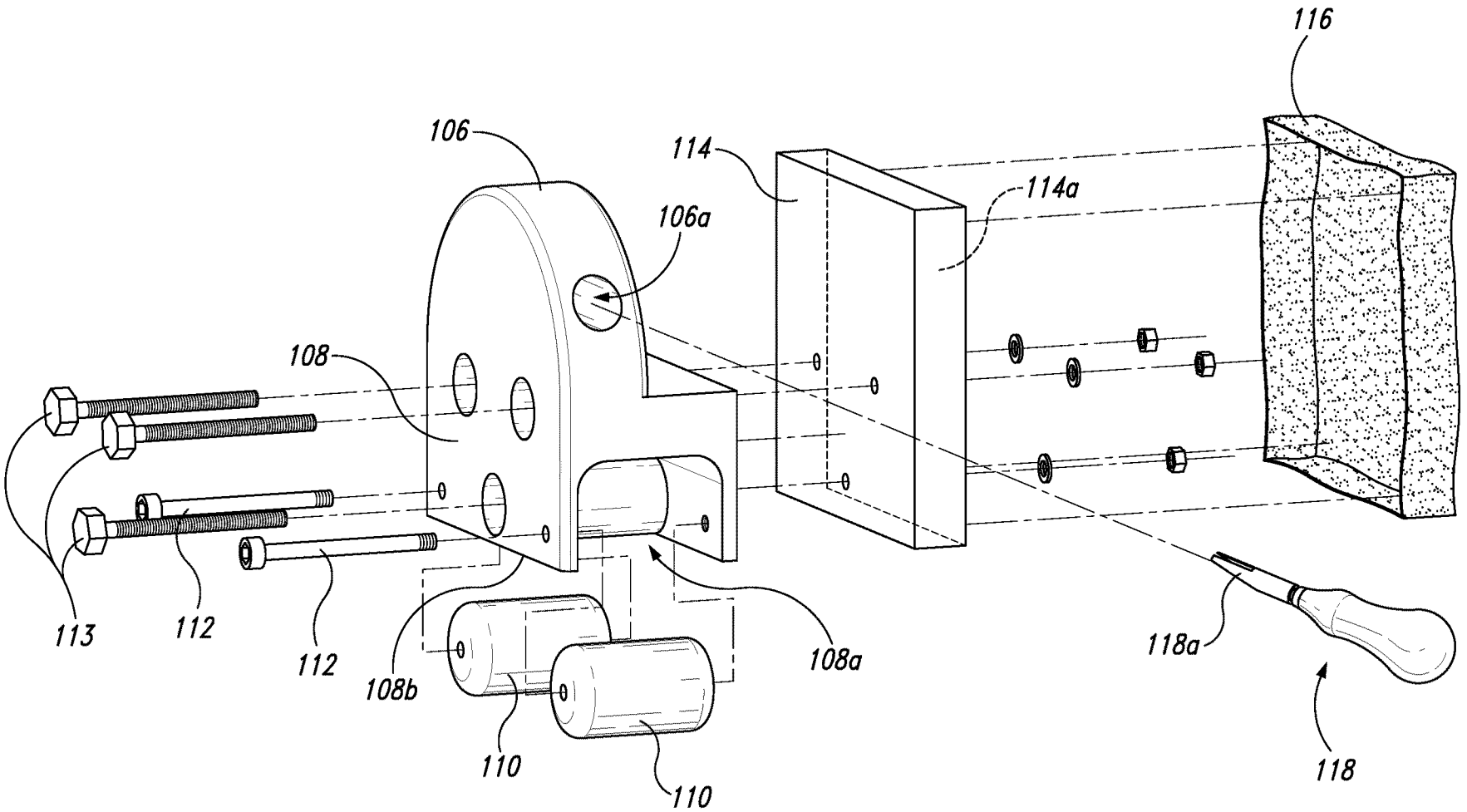
FIG. 1 is a side front perspective exploded view of a handheld rollable tool for installing a cove base molding along a bottom portion of a wall adjacent to a floor in accordance with an embodiment of the present invention.
Figure 2:
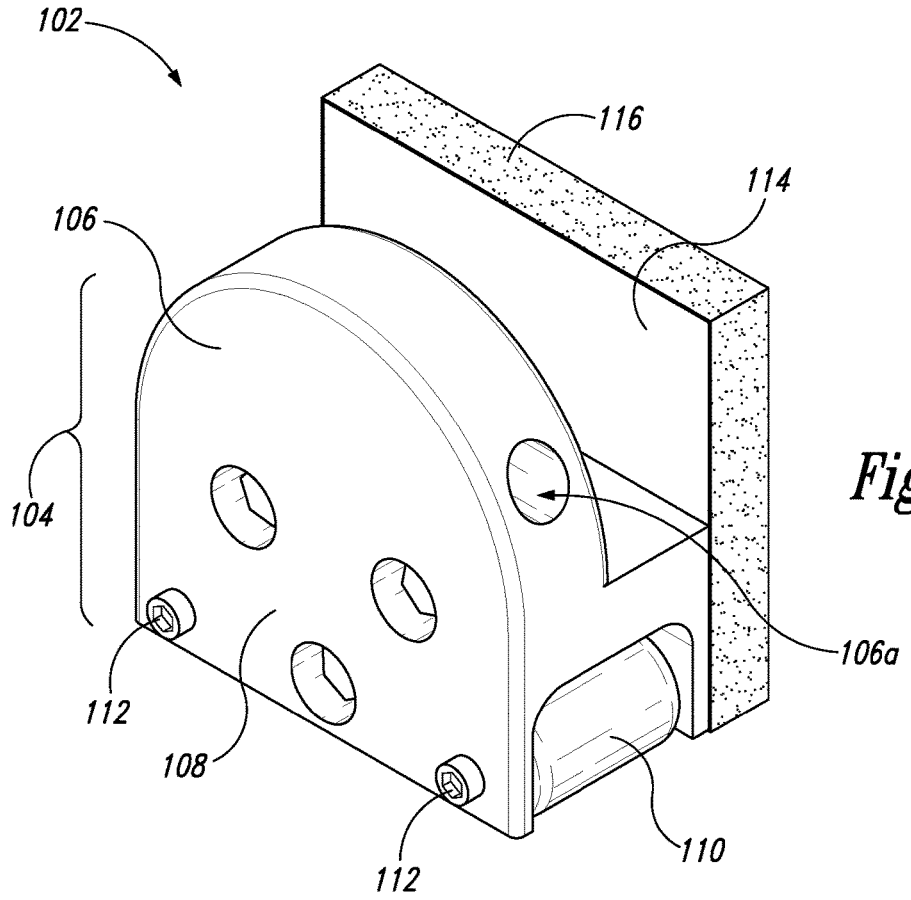
FIG. 2 is an elevated handle side perspective view of the handle-side of the handheld rollable tool illustrated in FIG. 1.
Figure 5:
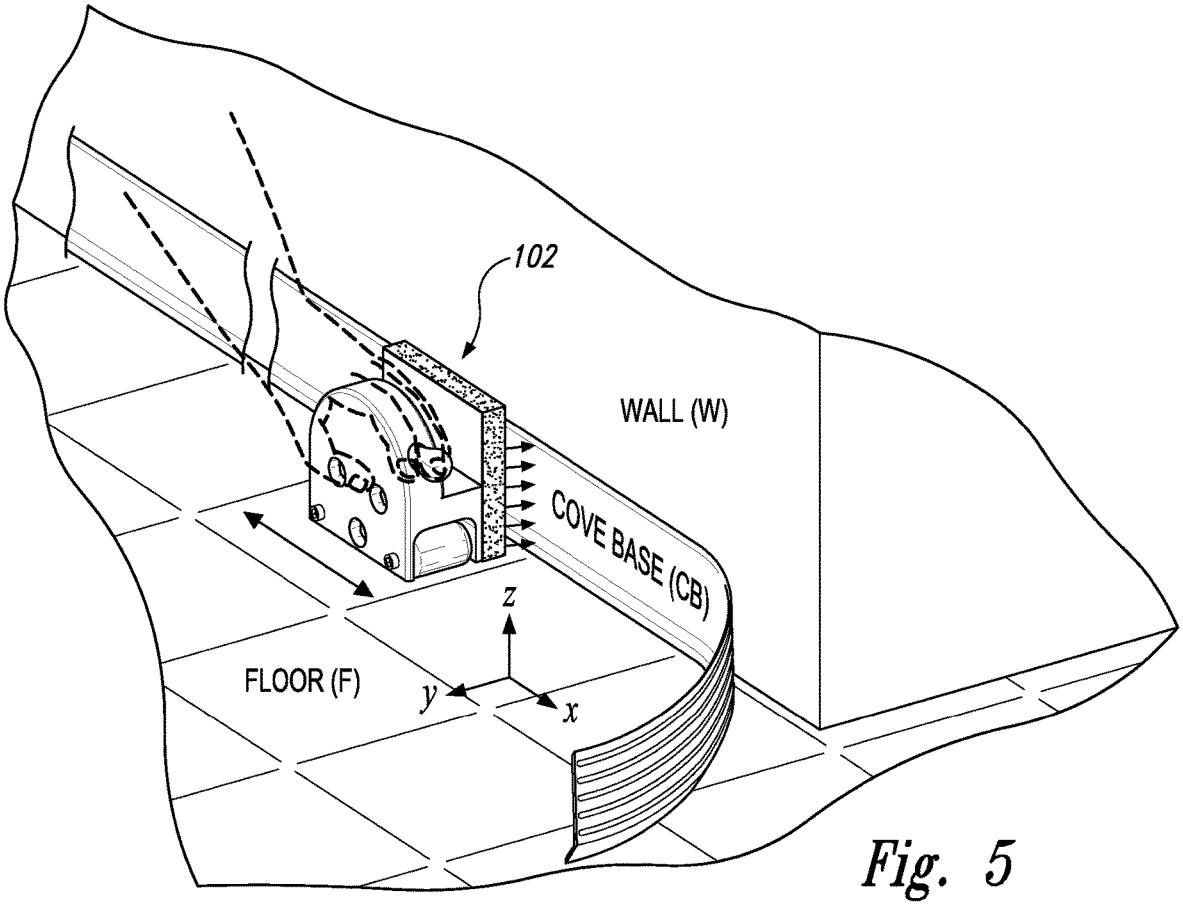
FIG. 5 illustrates a handheld rollable tool for installing a cove base CB molding along a bottom portion of a wall W adjacent to a floor F in accordance with an embodiment of the present invention.

In contrast, the bottom section 108 includes at least a recess 108*a* (positioned on a bottom face 108*b* as best shown in FIG. 1) that houses a plurality of wheels 110. As shown, the plurality of wheels 110 may be two (or more) rollers fitted partially within a pair of recesses 108*a* and attached to the bottom section 108 of the base 104 by a pair of corresponding transverse axels 112. In this configuration, the wheels 110 enable the user to roll the handheld rollable tool 102 back and forth along the wall W and the floor F (when the handheld rollable tool 102 is being used for installing a selected piece of cove base CB molding as shown FIG. 5). In practice and as best shown in FIG. 5, the handheld rollable tool 102 is configured to nestle up against the wall W and the floor F at their juncture and roll back-and-forth along the wall W with an applied pressure (force) against the wall W.

Figure 3:
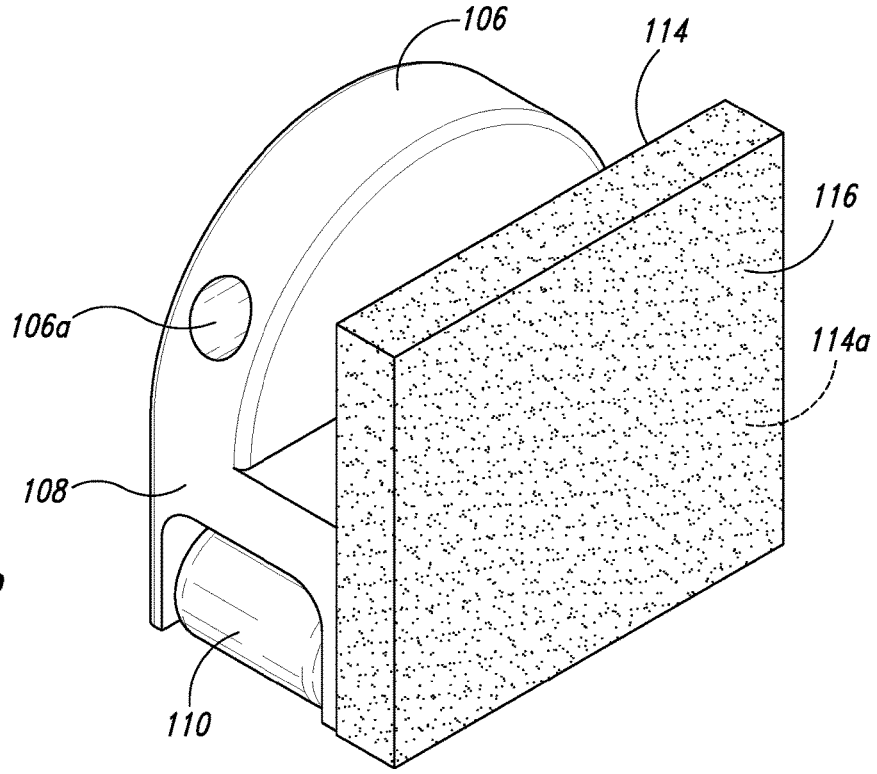
FIG. 3 is an elevated side baseplate perspective view of the baseplate-side of the handheld rollable tool illustrated in FIG. 1.
Figure 4:
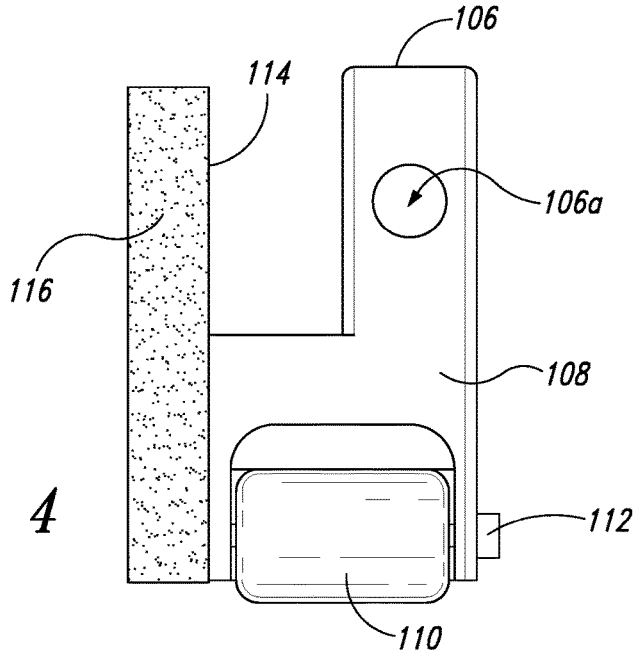
FIG. 4 is a front view of the handheld rollable tool illustrated in FIG. 1.

As further shown, a baseplate 114 is attached to the bottom section 108 of the base 104 and extends outwardly away from the base 104. Similar to the base 104, the attached baseplate 114 is also preferably made of a rigid material such as, for example, wood or a hard plastic. As best shown in FIG. 3, the baseplate 114 has a substantially flat exterior face 114*a* that, when the handheld rollable tool 102 is nestled up against the wall W is parallel to the wall W and perpendicular to the floor F (as best shown in FIG. 5).

In order to facilitate the installation of the cove base CB molding, the flat exterior face 114*a* preferably comprises a pliable material 116 (selected form a felt, a textile material, or a combination thereof) positioned on and covering the flat exterior face 114*a*. The selected pliable material 116 should be soft, supple, and enable gliding of the handheld rollable tool 102 along and over the cove base CB molding during its installation—while simultaneously cleaning and buffing the outside surface of the cove base CB molding.

In further embodiments, and as best shown in FIG. 1, the present invention is directed to the handheld rollable tool 102 in combination with a cove base groover tool 118. As shown, a top section hole 106*a* extends into the top section 106 of the base 104, wherein the hole 116*a* is sized and configured to receive a blade section 118*a* of a cove base groover tool 118. As shown, the blade section 118*a* of the cove base groover tool 118 is insertable within the hole 106*a*.

Figure 6:
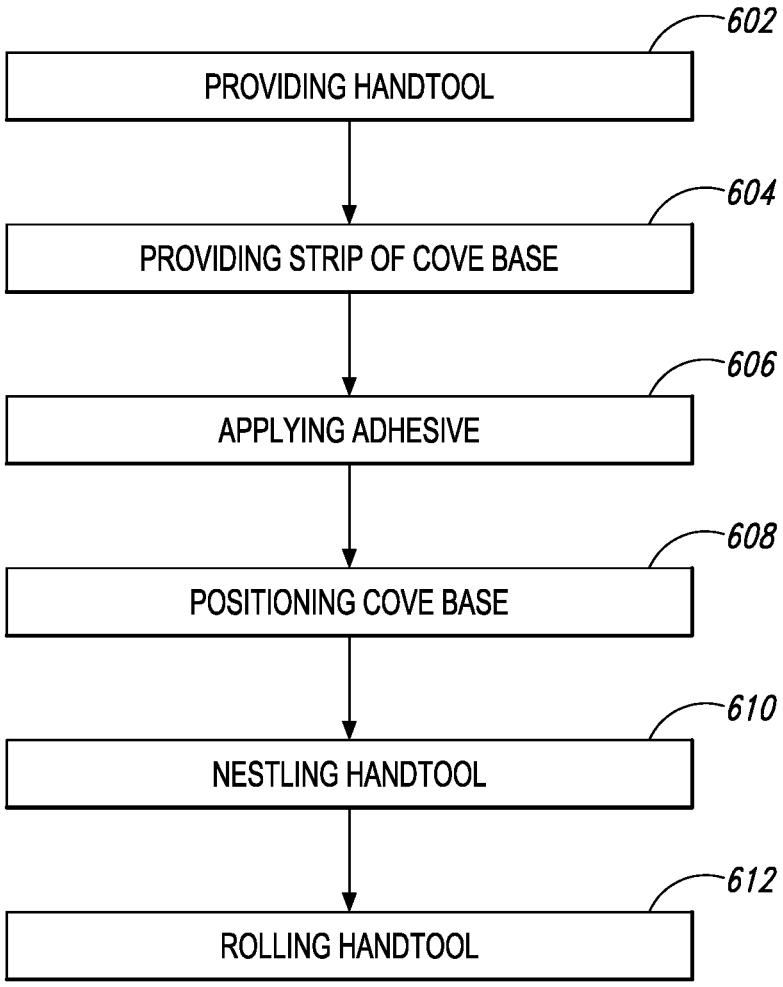
FIG. 6 is a flowchart depicting the different steps of a method for installing a piece of cove base molding along a bottom portion of a wall adjacent to a floor in accordance with an embodiment of the present invention.

In another embodiment, the present invention is directed to a method for installing cove base molding along a bottom portion of a wall adjacent to a floor. As illustrated in the flowchart of FIG. 6, the method comprises the steps of: providing a handheld rollable tool as described above (block 602); providing a strip of cove base molding (wherein the strip of cove base molding has a frontside and a backside) (block 604); applying an adhesive to the backside of the strip of cove base molding (block 606); positioning the backside of strip of cove base molding with the applied adhesive along the bottom portion of the wall adjacent to the floor (block 608); nestling the handheld rollable tool against the bottom of the wall and the floor (block 610); and rolling the handheld rollable tool back and forth along the wall while applying an inward force against the wall so as to thereby adhere the base cove molding to the bottom portion of the wall (block 612).

While the present invention has been described in the context of the embodiments illustrated and described herein, the invention may be embodied in other specific ways or in other specific forms without departing from its spirit or essential characteristics. Therefore, the described embodiments are to be considered in all respects as illustrative and not restrictive. The scope of the invention is, therefore, indicated by the appended claims rather than by the foregoing description, and all changes that come within the meaning and range of equivalency of the claims are to be embraced within their scope.

What is claimed is:

1. A handheld rollable tool for installing a cove base molding along a bottom portion of a wall adjacent to a floor, comprising: a base having a top section and a bottom section, wherein the top section is in the form of a handle that is configured to be gripped by a user's hand; a plurality of rotatable wheels attached to the bottom section of the base, wherein the plurality of rotatable wheels is configured to allow the handheld rollable tool to roll back and forth along the wall and the floor when the handheld rollable tool is being used for installing the cove base molding; a baseplate attached to the bottom section of the base and extending outwardly away from the base, wherein the baseplate has a substantially flat exterior face that is parallel to the wall and perpendicular to the floor when the handheld rollable tool is nestled up against the wall and the floor; a felt, a textile material, or a combination thereof, positioned on and covering the substantially flat exterior face; and a hole extending into the top section of the base, wherein the hole is sized and configured to receive a blade section of a cove base groover tool.

2. The handheld rollable tool of claim 1, further comprising a cove base groover tool, wherein the blade section of the cove base groover tool is inserted within the hole.

3. The handheld rollable tool of claim 2 wherein the plurality of rotatable wheels is two or more rollers fitted partially within a recess positioned on a bottom face of the bottom section of the base.

4. The handheld rollable tool of claim 3 wherein the top section of the base is semi-circular in shape.

5. The handheld rollable tool of claim 2 wherein the base and the baseplate are each made of a rigid material.

6. A method for installing cove base molding along a bottom portion of a wall adjacent to a floor, the method comprising the steps of:

providing a handheld rollable tool according to claim 1; providing a strip of cove base molding, wherein the strip of cove base molding has a frontside and a backside;

applying an adhesive to the backside of the strip of cove base molding;

positioning the backside of strip of cove base molding with the applied adhesive along the bottom portion of the wall adjacent to the floor;

nestling the handheld rollable tool against the bottom of the wall and the floor; and rolling the handheld rollable tool back and forth along the wall while applying an inward force against the wall so as to thereby adhere the base cove molding to the bottom portion of the wall.

* * * * *